United States Patent [19]

Allison

[11] Patent Number: 4,534,276

[45] Date of Patent: Aug. 13, 1985

[54] ROOM HEAT CIRCULATION SYSTEM

[76] Inventor: Arlie E. Allison, P.O. Box 7445, Beaumont, Tex. 77706

[21] Appl. No.: 665,313

[22] Filed: Oct. 26, 1984

[51] Int. Cl.[3] ..... F24F 7/06

[52] U.S. Cl. ..... 98/34.5; 98/29; 98/31.5

[58] Field of Search ..... 98/33 A, 33 R, 32, 31, 98/29, 38

[56] References Cited

U.S. PATENT DOCUMENTS

| | | | |
|---|---|---|---|
| 2,582,356 | 1/1952 | Rauhut | 98/33 A |
| 2,615,383 | 10/1952 | Jenn | 98/33 A |
| 2,625,872 | 1/1953 | Follansbee et al. | 98/33 A |
| 2,765,726 | 10/1956 | Powers | 98/33 A |
| 2,834,278 | 5/1958 | Conte, Jr. | 98/29 |
| 2,891,615 | 6/1959 | Farrell | 98/29 |
| 3,173,353 | 3/1965 | Watkins | 98/29 |
| 3,347,025 | 10/1967 | Wiley | 55/279 |
| 4,136,606 | 1/1979 | Wolbrink . | |
| 4,168,797 | 9/1979 | Luke . | |
| 4,274,330 | 6/1981 | Witten et al. | 98/29 |

FOREIGN PATENT DOCUMENTS

| | | | |
|---|---|---|---|
| 155329 | 12/1981 | Japan | 98/31 R |
| 192734 | 11/1982 | Japan | 98/31 R |

*Primary Examiner*—Henry C. Yuen

*Attorney, Agent, or Firm*—Fulbright & Jaworski

[57] ABSTRACT

A room heat circulation system for circulating warm air from the top of a room to the bottom of the room using a wall of the room as a duct. A do it yourself kit including a fan and upper grill connected to a housing is adapted to be inserted into an upper opening in the wall and a bottom grill is adapted to be inserted into a lower opening in the wall. The upper grill has upwardly directed louvers and the bottom grill has downwardly directed louvers for drawing in warm air from the top of the room by the fan and exhausting the warm air into the bottom of the room. Retractable and expandable connecting means are connected to the housing and the lower grill and operable from the front whereby each of the connecting means may be retracted for installing the units into the openings and then extended for engaging the edges of the opening.

4 Claims, 7 Drawing Figures

ROOM HEAT CIRCULATION SYSTEM

BACKGROUND OF THE INVENTION

Heated air rises and tends to accumulate near the ceiling of any room creating temperature variations of as much as 25° F. between the floor and the ceiling. This stratification of air in layers of varying temperature creates uncomfortable living conditions and expensive heat losses. Various systems, such as disclosed in U.S. Pat. Nos. 4,168,797; 4,136,606; 3,173,353; and 3,347,025 have disclosed various sytems for circulating the warm air at the ceiling to the floor. However, such systems are expensive, complicated and are not suitable for installation by a do it yourselfer.

The present invention is directed to a room heat circulation system using the wall of the room as a duct. The kit requires the user to make only an upper opening in the wall and a lower opening in the wall. The kit can then be installed early without tools.

SUMMARY

The present invention is directed to a room heat circulation system for circulating warm air from the top of a room to the bottom of the room using a wall of the room as a duct. A fan and upper grill is connected to a housing and the housing is adapted to be inserted into an upper opening in the wall. The upper grill has upwardly directed louvers for drawing in warm air by the fan from the top of the room. A first retractable and extendable connecting means is connected to the back of the housing and is operable from the front of the housing whereby the connecting means may be retracted for installing the housing into the upper opening and then extended for engaging the edge of the upper opening for securing the housing in the upper opening. A bottom grill is adapted to be inserted into a lower opening in the wall and the bottom grill has downwardly directed louvers for exhausing warm air from the wall duct to the bottom of the room. Second retractable and extendable means is connected to the back of the lower grill and is operable from the front of the lower grill so that the second connecting means may be retracted for installing the lower grill into the lower opening and then extended for engaging the edge of the lower opening for securing the lower grill in the lower opening.

A still further object of the present invention is wherein the first retractable and extendable connecting means includes a plurality of slots in the housing directed outwardly towards the opening and a plurality of L-shaped clips are provided each having a threaded bolt extending through one of the slots and a nut for attachment to each threaded bolt.

Still a further object of the present invention is wherein the second retractable and extendable connecting means includes a retainer bar positioned on the back of the bottom grill and pivotally connected thereto by a rotatable knob on the front of the grill for retracting and extending the retainer bar.

Still a further object is wherein clip guides are provided on each side of each L-shaped clip for maintaining the clip in position for engaging the edge of the upper opening and for centering the housing in the upper opening.

A further object is the provision of stop ribs on each side of the retainer bar for aligning the bar in a retracted or extended position.

Yet a still further object is wherein the L-shaped clips include a scored break away leg for suitable adjusting the length of the leg to accommodate various thickness walls.

Still a further object is wherein the L-shaped clips include an L-shaped body having a thread bolt connected to the middle of the foot of the L-shaped body for assisting in clamping the clip to the wall.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
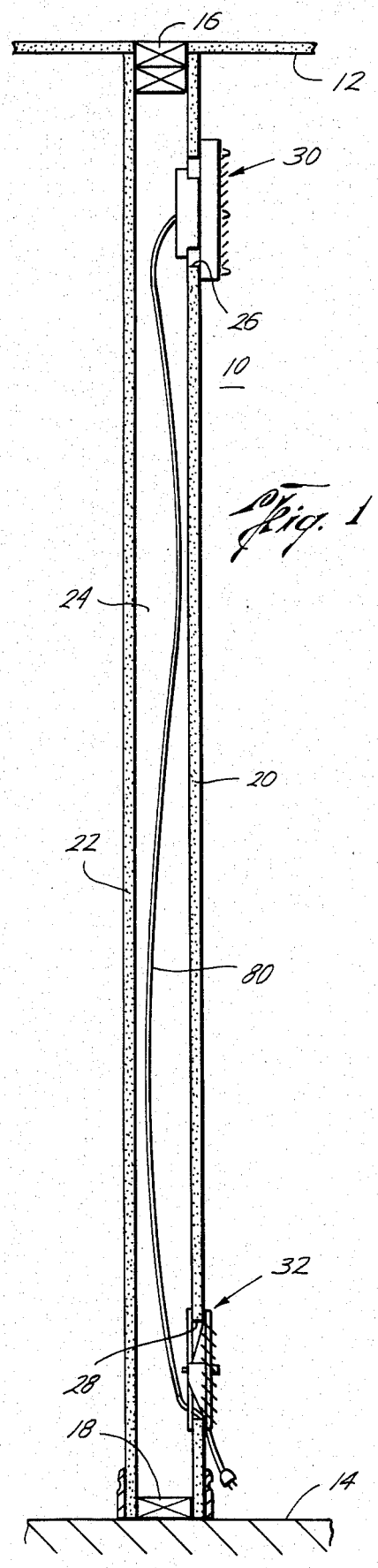
FIG. 1 is an elevational view of a cross section of a wall of a room having the present invention installed therein.

Referring now to the drawings, and particularly to FIG. 1, the reference numeral 10 generally indicates a room having a ceiling 12 and a floor 14. The room 10 also includes a sidewall formed by upper supports 16, lower support 18, upper directed studs in the wall (not shown) and wall covering 20 and 22, all of which form a wall duct 24 therein. Normally, the temperature in the room 10 adjacent the ceiling 12 is much greater than the temperature of the air in the room adjacent the floor 14, for example, on the order of a difference of 25° F. The present invention is directed to circulating the warm air at the top to the bottom of the room 10 for utilizing this warm air and conserving energy. In the present invention a user merely makes an upper opening 26, preferably circular, and a lower opening 28, generally rectangular such as by sawing. Thereafter, an upper unit generally indicated by the reference numeral 30 is installed in the upper opening 26 and a lower unit generally indicated by the reference numeral 32 is installed in the lower opening.

Figure 2:
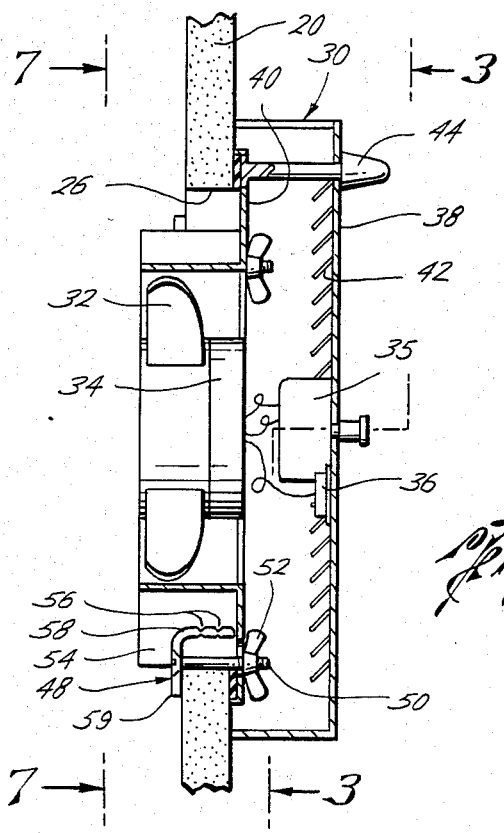
FIG. 2 is an enlarged elevational view, in cross section, of the fan and upper grill and housing installation.

Referring now to FIG. 2, the upper unit 30 includes an electrical fan 32 driven by an electric motor 34 controlled by a switch 35 and preferably includes a thermostat 36, and an upper grill 38, all connected to a housing 40. The grill 38 includes upwardly directed louvers 42 for drawing in warm air from the top of the room 10 by the fan 32 and directing the air downwardly through the duct 24 to the lower unit 32. The grill 32 is secured to the housing 40 by nuts 44. It is important that the fan 32 be located in the upper unit 30 as the duct 24 may not be air tight and if the fan were provided in the lower unit 32 the exhausted air may draw in cool air from other locations as well as the warm air at the top of the room 10.

Figure 3:
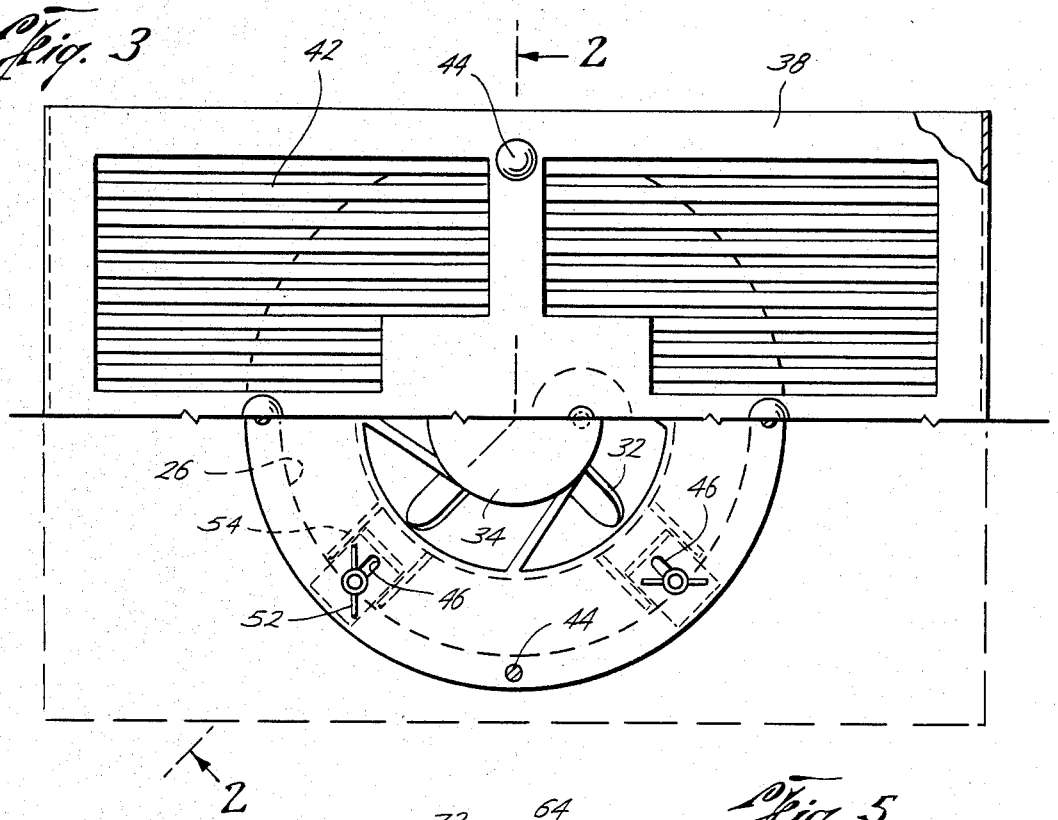
FIG. 3 is a cross-sectional view taken along the line 3—3 of FIG. 2.

First retractable and extendable connecting means are provided connected to the back of the housing 40, but operable from the front of the housing 40 whereby the connecting means may be retracted for installing the housing 40 into the opening 26 and then may be extended for engaging the edges of the wall covering 20. Referring now to FIGS. 2 and 3, the first retractable and extendable connecting means may include a plurality of slots 46 in the housing 40. The slots are directed radially outwardly towards the opening 26. A plurality of L-shaped clips 48 are provided each having a threaded bolt 50 which extends through one of the slots 46. In order to retract the clips 48 the threaded bolts 50 are slid inwardly in the slots 46 so that the outer end of the clips 48 may be inserted into the opening 26 as the units 30 is inserted into the opening 26. Thereafter, the threaded bolts 50 are slid outwardly in the slots 46 to allow the outer ends of the clips 48 to engage the edge of the opening 26 and engage the back of the wall covering 20. The nuts 52 are then tightened to secure the unit 30 in place in the opening 26. Clip guides such as walls 54 may be provided on each side of each clip 48 on the back of the housing 40 for maintaining the rotational position of the clip 48 as the clip 48 is moved inwardly and outwardly in the slots 46 so that the clip is aligned for engaging the back of the wall covering 20. The clip guides 54 extend radially outwardly and act to center the housing 40 in the upper opening 26 in the wall 20. Preferably, the L-shaped clips 48 include a leg 58 and a foot 59 with the threaded bolt 50 connected to the foot 59 between the ends of the foot 59. Therefore, the foot engages the back of wall 20 and the end of the leg 58 engages the back of the front of the housing 40. This structure assists in securely clamping the clip 48 to the wall 20. Furthermore, as best seen in FIG. 1, the L-shaped clip 48 may include a leg 58 having scored sections 56 which may be broken away for suitably adjusting the length of the leg 58 to suitably accommodate various thicknesses of the wall covering 20.

Figure 4:
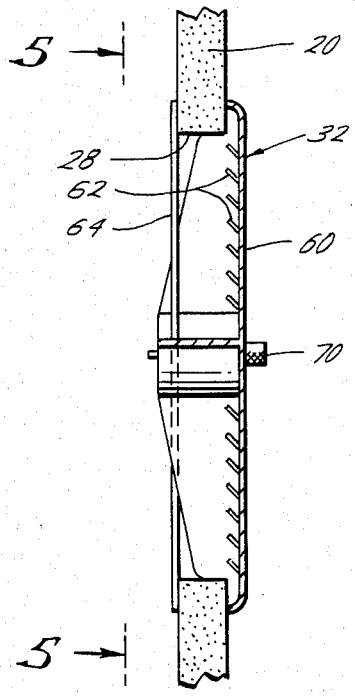
FIG. 4 is an enlarged elevational view, in cross section of the lower grill installed in place.
Figure 5:
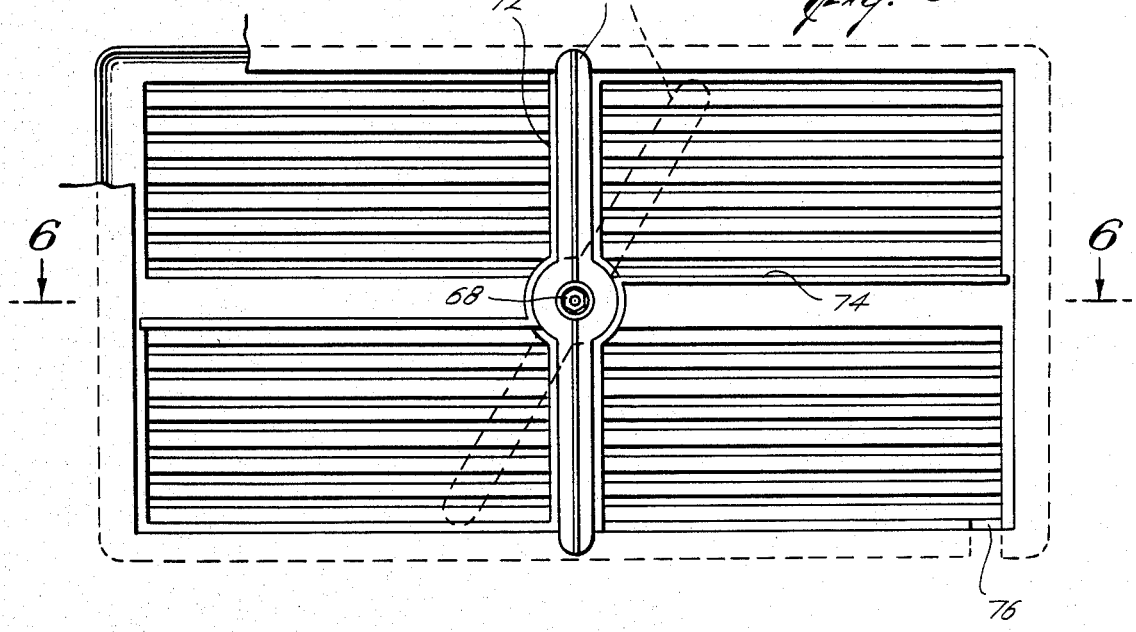
FIG. 5 is a cross-sectional view taken along the line 5—5 of FIG. 4.
Figure 6:
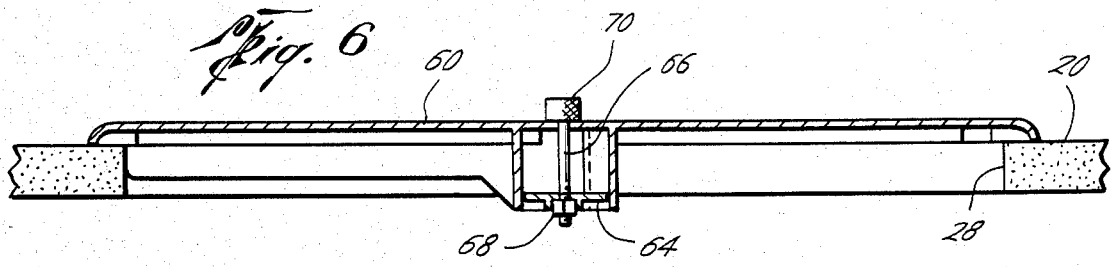
FIG. 6 is a cross-sectional view taken along the line 6—6 of FIG. 5.
Figure 7:
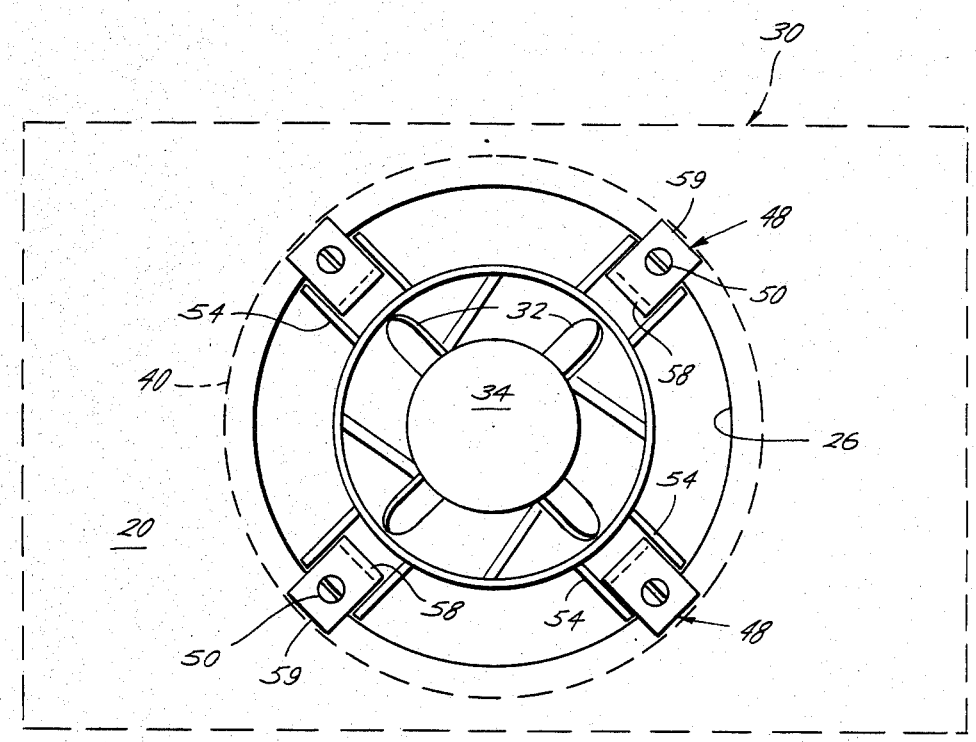
FIG. 7 is a cross-sectional view taken along the line 7—7 of FIG. 1.

Referring now to FIGS. 4, 5 and 6, the installation of the lower unit 32 is best seen. The lower unit consists of a grill 60 having downwardly directed louvers 62 for exhausting warm air from the duct 24 to the bottom of the room 10. The grill 60 is sized to cover the opening 28 and includes a second retractable and extendable connecting means connected to the back of the lower grill 60 which is operable from the front of the lower grill 60. Thus the second connecting means may be retracted for installing the lower grill 60 into the lower opening 28 and thereafter extended for engaging the edge of the lower opening 28 and the back of the wall covering 20 for securing the lower grill 60 in place. The second retractable and extendable connecting means may include a retainer bar 64 which is pivotally connected to the grill 30 by a pin 66 and locked thereto by a nut 68. A rotatable knob 70 is connected to the pin 66 and is positioned on the front of the grill 60 for rotating the retainer bar 64. Thus, the retainer bar 64 may be rotated to a position so that it may be installed through the opening 28, as best seen in dotted outline, and thereafter rotated to an engaging position as best seen in FIGS. 4 and 5 for engaging the back edges of the wall covering 20 and securing the grill 60 in place. Preferably, as best seen in FIG. 5, stops 72 and 74 are provided on opposite sides of the retainer bar 64 for limiting its angle of rotation between an extracted and extended position.

The grill 60 also may include a notch 74 to allow the passage of an electrical cord 80 from the upper unit 30 through the lower opening 28 for connection to an electrical outlet.

The present invention may be quickly and easily installed by sawing an upper opening 26 and a lower opening 28 in the wall covering 20. The housing 40 of the upper unit 30 is then inserted into the opening 20 by retracting the clips 48 and inserting the electrical cord into the duct 24 and inserting the housing 40 into the opening 26. The clips 48 are then moved outwardly to engage the edges of the opening 26 and the nuts 52 are tightened to secure the housing 40 in place. The upper grill 38 is then attached to the housing 40 by the nuts 44. The lower end of the electrical cord 80 is then retrieved through the lower opening 28. The lower grill 60 is then installed in the lower opening 28 by rotating the retainer bar 66 to an out of the way position so that it may be inserted into the lower opening 28. The knob 70 is then rotated to bring the ends of the retainer bar 60 behind the wall covering 20 to secure the lower unit 32 in place.

The present invention, therefore, can be quickly and easily installed by a user without requiring any tools except a saw and without any expertise. The switch 35 may be activated and the thermostat 36 will operate the fan motor 34 at any time in which the heat in the upper portion of the room 10 is above a predetermined level. Since the duct 24 in the wall of the room 10 is used as the conveyor of the warm air, the expense of the present invention is at a minimum and requires only the installation of the upper unit 30 and the lower unit 32.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts, will readily suggest themselves to those skilled in the art and which are encompassed within the spirit of the invention and the scope of the appended claims.

What is claimed is:

1. A room heat circulation system for circulating warm air from the top of a room to the bottom of the room using a wall of the room as a duct comprising, a fan and upper grill connected to a housing and said housing adapted to be inserted in an upper opening in said wall, said grill having upwardly directed louvers for drawing in warm air by the fan from the top of the room, said housing having a plurality of slots directed radially outwardly towards the edge of said upper opening when the housing is inserted therein, a plurality of L-shaped clips positioned on the back of the housing, each clip having a threaded bolt extending through one of the slots whereby the clips may be retracted in the slot for inserting the housing into the upper opening and may then be extended to engage the edge of the upper opening, a nut for attachment to the each threaded bolt for securing the housing in the upper opening, a bottom grill adapted to be inserted in a lower opening in the wall, said grill having downwardly directed louvers for exhausting warm air from the wall duct to the bottom of the room, a retainer bar positioned on the back of the bottom grill and pivotably connected thereby by a rotatable knob on the front of the grill whereby the bar may be rotated out of the way for inserting the bottom grill into the bottom opening and then rotated into engagement with the edge of the bottom opening for securing the bottom grill in the lower opening, clip guides on each side of each L-shaped clip for maintaining the clip in position for engaging the edge of the upper opening, and said clip guides are positioned on the back of the housing and extend radially outwardly for centering the housing in the upper opening.

2. The apparatus of claim 1 wherein the L-shaped clips include a leg and a foot with the threaded bolt connected to the foot between the ends of the foot.

3. The apparatus of claim 1 including, stop ribs on each side of the retainer bar for aligning the bar in a retracted or an extended position.

4. The apparatus of claim 1 wherein the L-shaped clip includes a scored break away leg for suitably adjusting the length of the leg to accommodate various thickness walls.

* * * * *